US005662409A

United States Patent [19]

Huang

[11] Patent Number: 5,662,409

[45] Date of Patent: Sep. 2, 1997

[54] NETWORK TYPE LIGHT SET STRUCTURE

[75] Inventor: Peter K. H. Huang, Taipei, Taiwan

[73] Assignee: Shining Blick Enterprises Co., Ltd., Taipei, Taiwan

[21] Appl. No.: 642,295

[22] Filed: May 3, 1996

[51] Int. Cl.[6] ..... F21P 1/02; F21V 21/00

[52] U.S. Cl. ..... 362/249; 362/123; 362/252

[58] Field of Search ..... 362/123, 249, 362/252, 239, 806, 234, 396, 250; 439/505, 541, 640

[56] References Cited

U.S. PATENT DOCUMENTS

| | | | |
|---|---|---|---|
| 4,720,773 | 1/1988 | Ahroni | 362/123 |
| 5,057,976 | 10/1991 | DuMong | 362/239 |
| 5,213,519 | 5/1993 | Dorfman | 362/123 |
| 5,424,925 | 6/1995 | Jenke et al. | 362/123 |
| 5,601,361 | 2/1997 | Lawrence | 362/238 |

*Primary Examiner*—Thomas M. Sember
*Attorney, Agent, or Firm*—Pro-Techtor International

[57] ABSTRACT

A decorative network type light set structure includes multiple small light bulbs that are used to constitute a surface for covering trees or buildings to achieve uniform light emission. It essentially includes a light set arranged in a meandering manner such that the curves of one line of the light set connects with the curves of another line of the light set, with light bulb holders and light bulbs disposed at where the curves meet. A heat-sealed plastic jacket is used to bind another section of the lead wire or the light bulb holder may be used to form a securing device for clamping purposes. The light emitting surface thus formed may be used to decorate gardens, walls and buildings.

2 Claims, 7 Drawing Sheets

NETWORK TYPE LIGHT SET STRUCTURE

BACKGROUND OF THE INVENTION (a) Field of the Invention

The present invention relates generally to a decorative light set structure, and more particularly to a light set which may be arranged to constitute a light emitting surface for covering objects to achieve uniform lighting effects.

(b) Description of the Prior Art

Light sets, such as Christmas light sets, are commonly used to decorate gardens, walls and posts of buildings on festive occasions to create a merry atmosphere. They are also often used by shops, restaurants and hotels to create attractive visual effects at night. FIGS. 1 and 2 show light sets A are used to encircle a tree or a post. Although light sets can create starry, flashing effects at night, they have the following disadvantages:

1. A long line of small light bulbs wound around the tree branches or the posts of buildings may look all right at night, but it will be very unsightly in the daytime.
2. The light set may easily get entangled when it is hung or stored.
3. It is difficult to properly arrange the light bulbs to obtain uniform flashing effects when they are hung.
4. Some part of the light set may easily drop from the tree or post as a result of inadvertent touching or strong wind, which is also very unsightly.

SUMMARY OF THE INVENTION

Accordingly, a primary object of the present invention is to provide a decorative, network type light set for directly covering trees and posts of buildings so that a light emitting surface of the light set may entirely envelope the trees or posts, eliminating the drawbacks with the prior art.

Another object of the present invention is to provide a network type light set with uniform distribution of light bulbs no matter whether the light set of the invention is disposed on trees or posts, and the lighting arrangement or effects may be achieved by controlling the size of the mesh.

A further object of the present invention is to provide a network type light set which may be rolled up or extended with ease so that the wires will not get entangled as in the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 3:
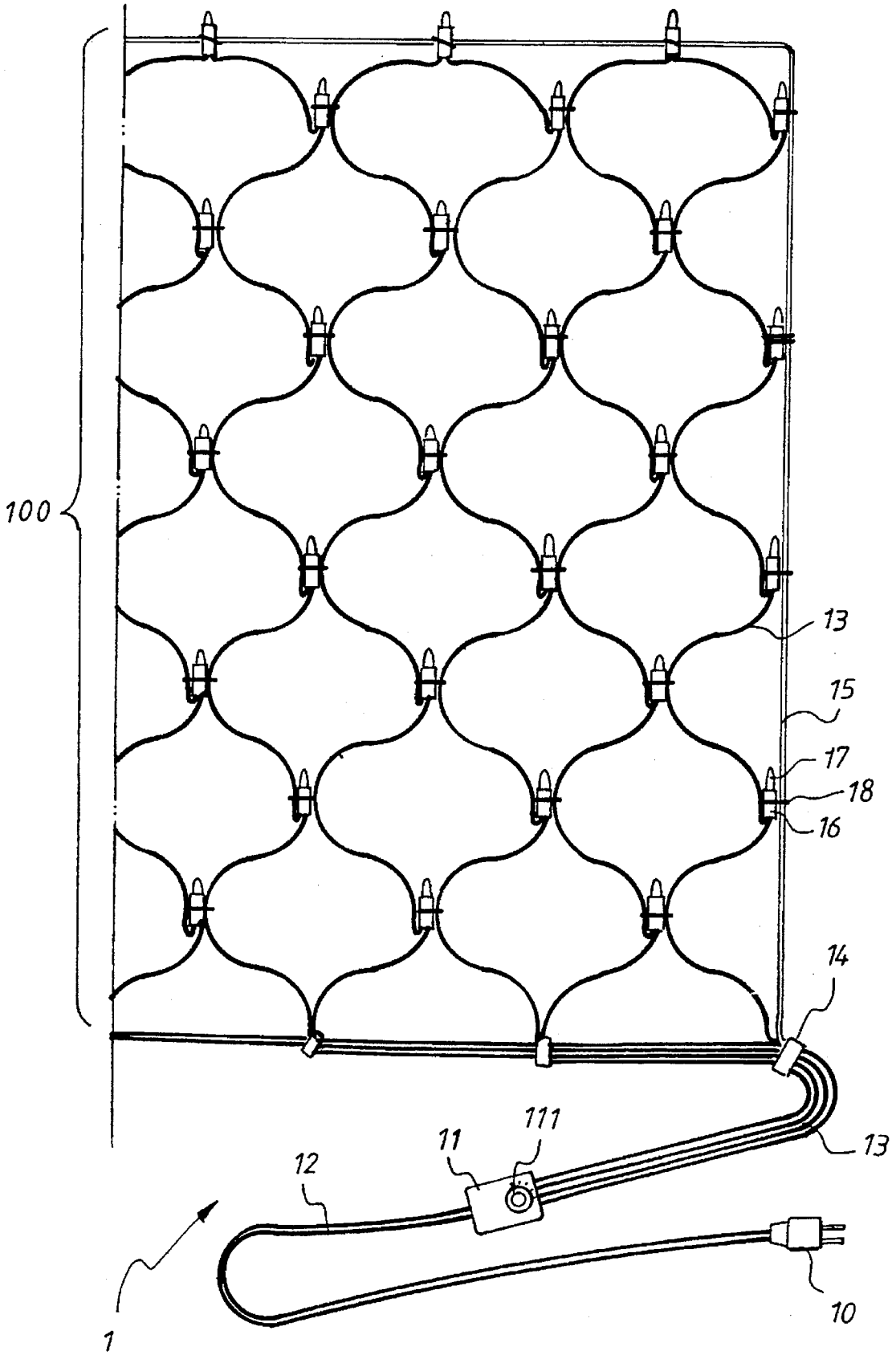
FIG. 3 is a schematic view of the network type light set of the invention in an extended state.

FIG. 3 shows a network type light set 1 of the invention in an extended state. The light set 1 essentially comprises an AC plug 10, an AC wire 12, an adapter 11 with a control button 111, a plurality of DC lead wires 13 connected to a rear side of the adapter 11, a plurality of light bulb holders 16 and light bulbs 17 equidistantly disposed on the lead wires 13, and a plurality of securing elements 14 for fastening juxtaposed lead wires 13 at suitable positions, so as to achieve a light emitting surface 100. A rope 15 may be disposed at the periphery of the light emitting surface 100 to form a border thereof.

As shown in FIG. 3, each lead wire 13 as well as the light bulb holders 16 and light bulbs 17 thereon is arranged to meander in an "S" shape for a determined length to form a "forward" section and then meander in an opposite direction in an "S" shape to form a "return" section. A fastening element 18 is used to tie every two contiguous curved bends of the "S" shapes. In particular, a light bulb holder 16 and an accompanying light bulb 17 are disposed at one of the two curved bends, and the fastening element 18 is used to tie the "forward" section of each lead wire 13 with the light bulb holder 16 on the "return" section, constituting a network of lead wires. Furthermore, all the light bulbs 17 are equidistantly positioned on the intersections; the rope 15 is also clamped with the lead wires 13 by means of the securing elements 14. When the rope 15 is pulled or the corners of the light emitting surface 100 are used as points of application of force, the light emitting surface 100 may be extended properly.

Figure 4:
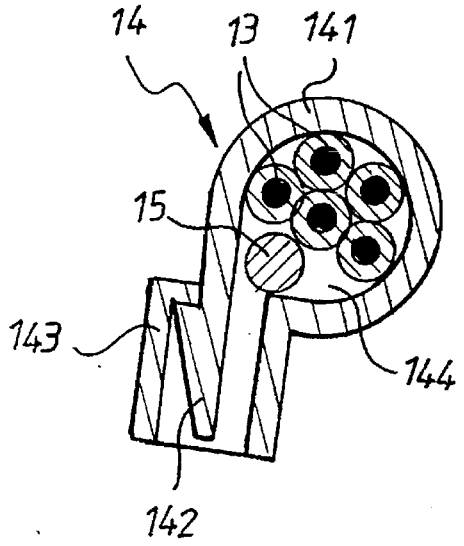
FIG. 4 is a sectional view of a securing device of the invention.

With reference to the embodiment shown in FIG. 4, the securing element 14 for clamping the lead wire 13 is a plastic element having resilience. The securing element 14 may be configured to have a flexible securing band 141 which has one end forming a seat 143 for a hole 144 and the other end forming a hook 142. The hook 142 is inserted into the hole 144 to form an annular securing structure. The securing element 14 thus formed may be used to wrap the lead wires 13 and even the rope 15 to achieve the desired tying effects.

Figure 5:
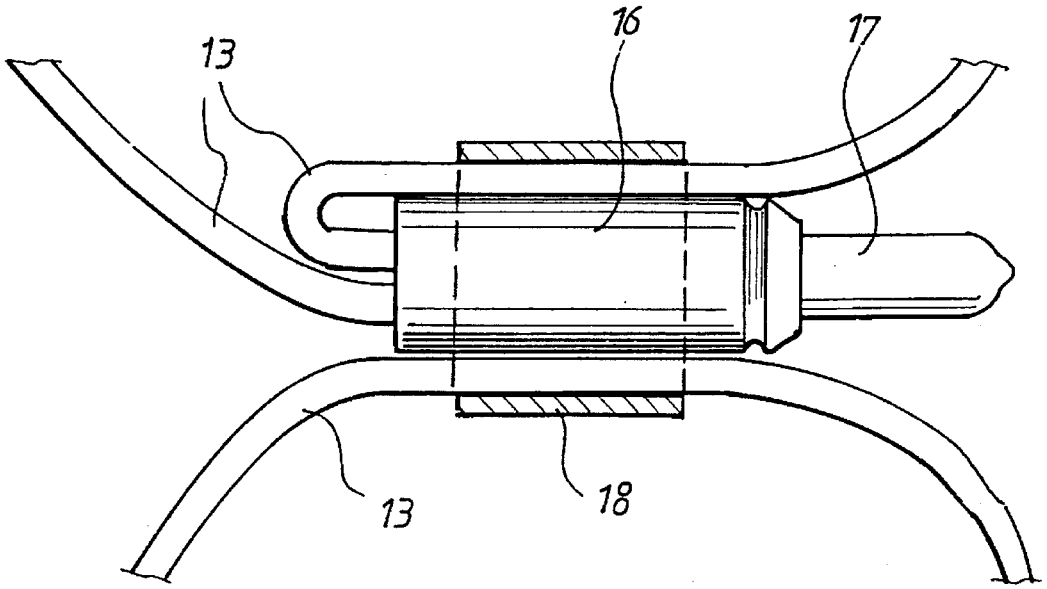
FIG. 5 is a sectional view of a fastening element of the invention.

In FIG. 5, the fastening element 18 may be an elastic band, a heat-sealed plastic jacket or adhesive tape for tying the lead wire 13 and the light bulb holder 16.

By means of the network light set prepared in the manner described above, light emitting surfaces or light emitting objects of various forms may be made. The light emitting surface 100 may be rolled into a conical or cylindrical shape to spread over a tree, hence achieving orderly and pleasing visual effects.

Figure 1:
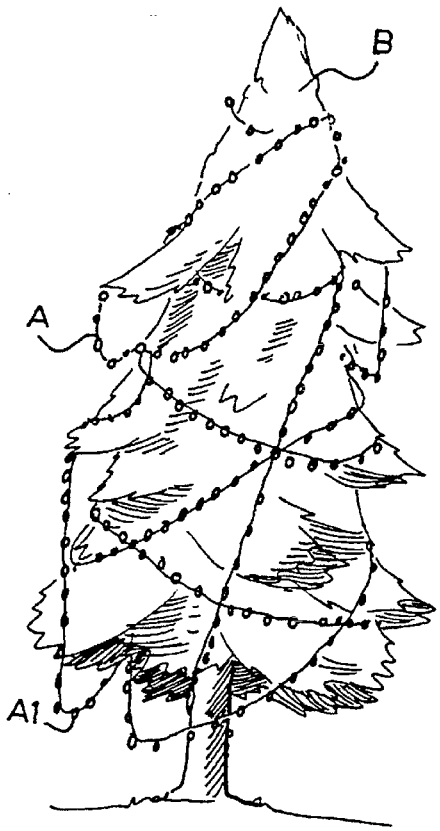
FIG. 1 (PRIOR ART)
FIG. 1 is a schematic view of a conventional light set wound on a tree.
Figure 2:
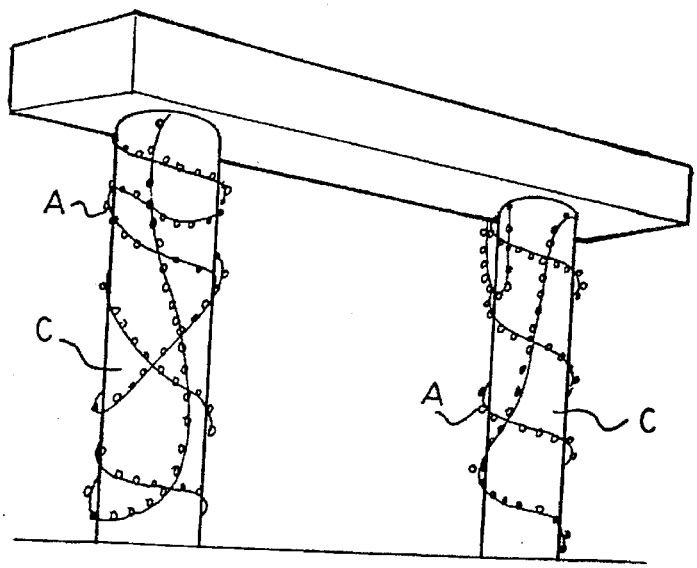
FIG. 2 (PRIOR ART)
FIG. 2 is a schematic view of conventional light sets wound on posts.
Figure 6:
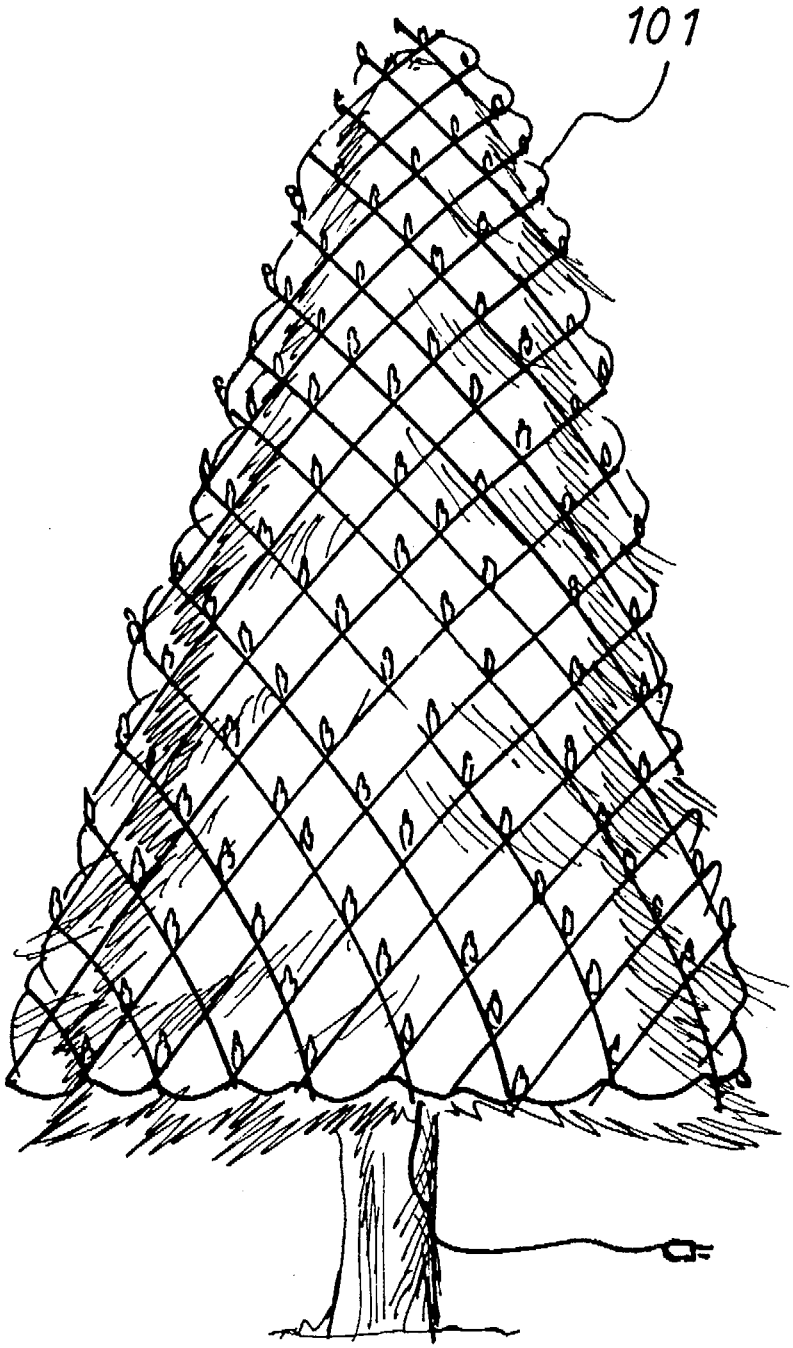
FIG. 6 is a schematic view of the network type light set of the invention arranged on a tree.

With reference to FIG. 6, a conical network type light set 101 formed by a light emitting surface 100 may be used to shroud a tree so that the light bulbs 17 may be uniformly distributed. Contrary to the prior art as shown in FIGS. 1 and 2, the present invention is much more tidy, orderly and visually pleasing. Mounting and disengagement of the light set 101 onto and from the tree is convenient. In particular, when a plurality of the light sets 101 are used on a row of trees, they will look more beautiful as a whole.

Figure 7:
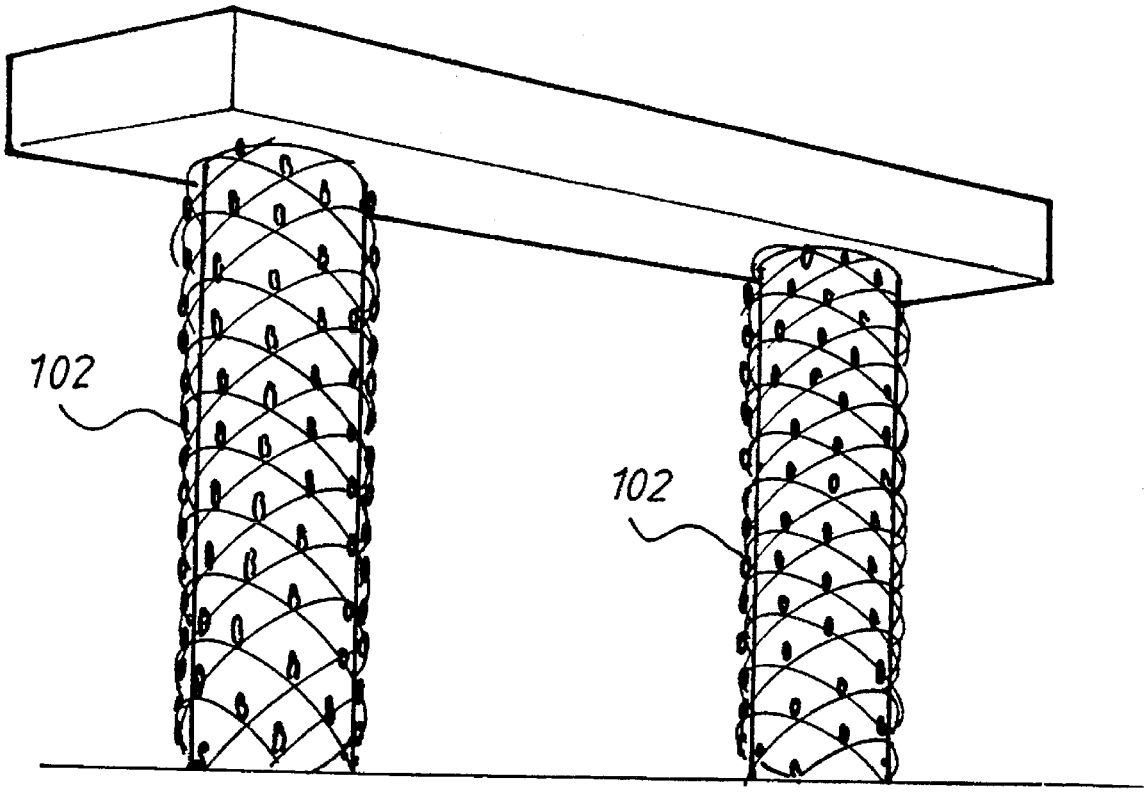
FIG. 7 is a schematic view of the network type light set of the invention arranged on posts.

With reference to FIG. 7, the light emitting surface 100 may be adapted to form a cylindrical network type light set 102 which is arranged on cylindrical posts or quadrilateral columns, beams or trees to achieve good visual effects. Comparing with the prior art shown in FIG. 2, the present invention is obviously much more orderly. Mounting and disengagement are likewise easy.

Figure 8:
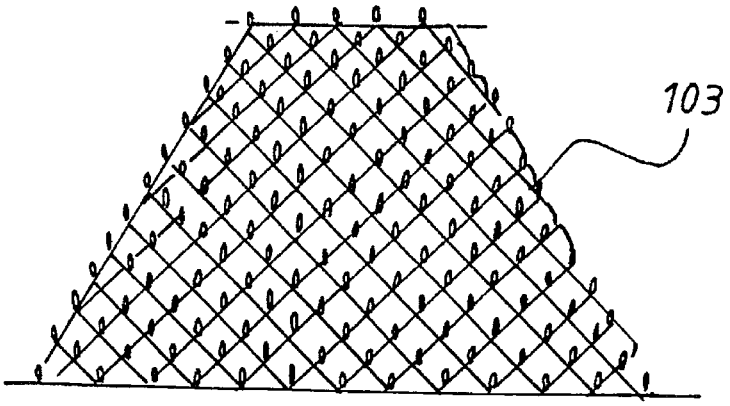
FIG. 8 is a first example of the network type light set of the invention.
Figure 9:
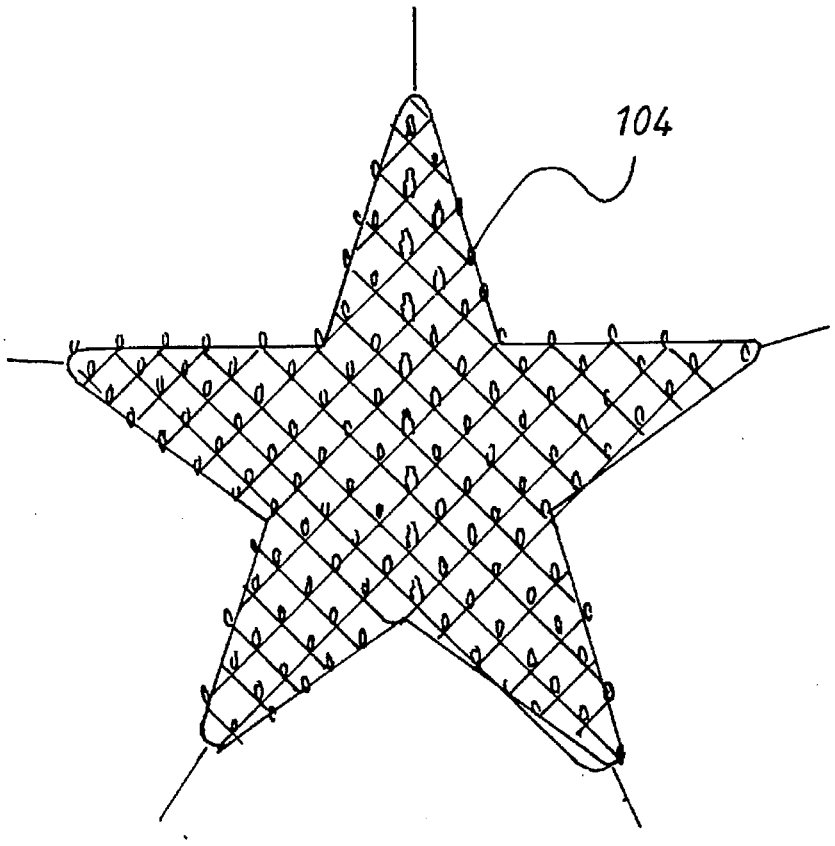
FIG. 9 is a second example of the network type light set of the invention.
Figure 10:
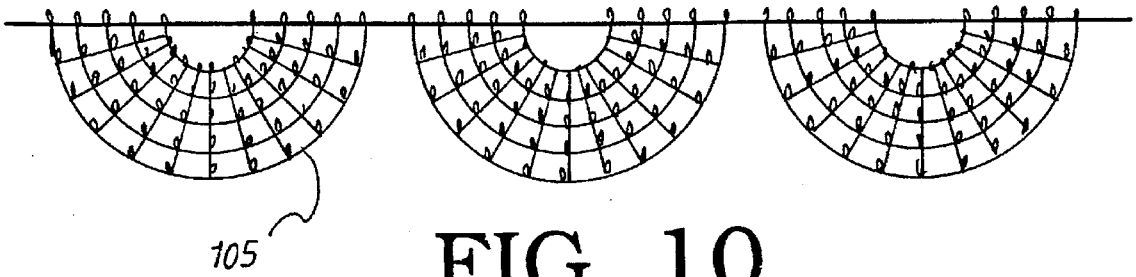
FIG. 10 is a third example of the network type light set of the invention.
Figure 11:
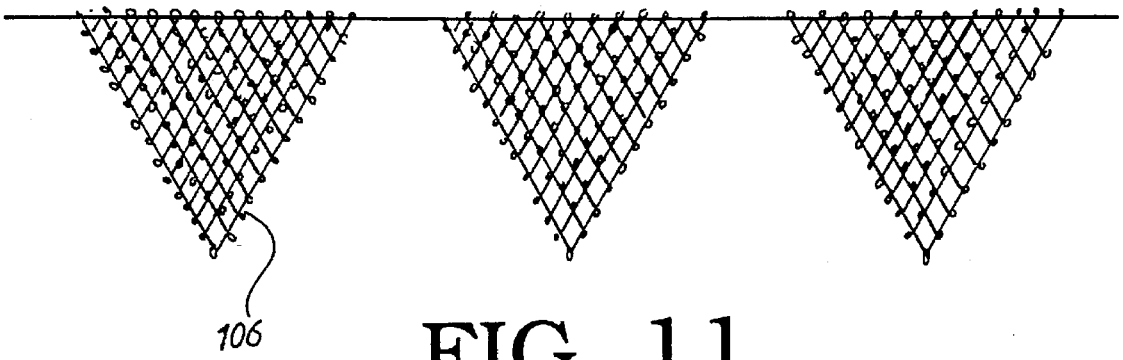
FIG. 11 is a fourth example of the network type light set of the invention.
Figure 12:
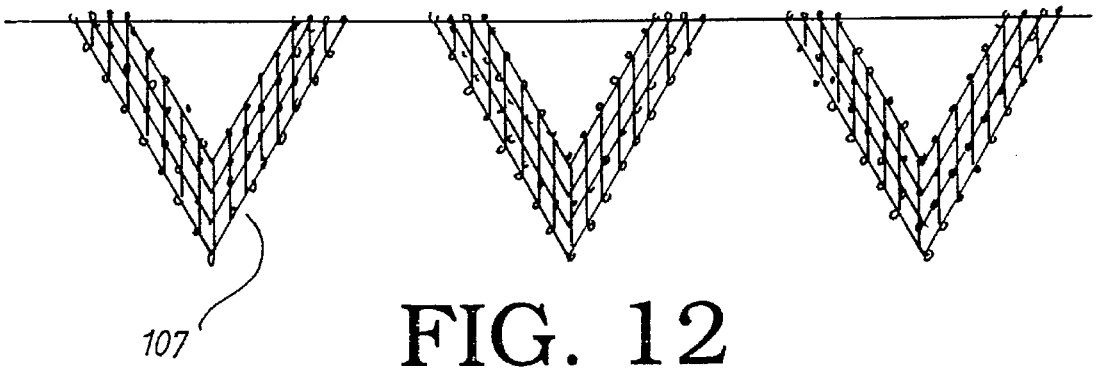
FIG. 12 is a fifth example of the network type light set of the invention.

The network type light sets according to the present invention may be used to achieve even more varied visual effects when they are installed on wall surfaces. With reference to FIG. 8, a trapezoidal network type light set 103 forms a trapezoidal light emitting surface, while a star-shaped network type light set 104 forms a star-shaped light emitting surface in FIG. 9. These light sets are suitable for hanging on the walls or at higher levels to constitute light emitting patterns at night. They may also be hung in rows on buildings to enhance the festive atmosphere. For instance, a row of semi-circular network type light sets 105 as shown in FIG. 10, a row of triangular network type light set 106 as shown in FIG. 11, and a row of V-shaped network type light sets 107 as shown in FIG. 12.

The hanging or opening of the varying light emitting surfaces of the network type light sets according to the present invention essentially relies on the control of the rope at their peripheries so that the meshes may be fully extended or opened, allowing all the light bulbs to be uniformly distributed on the surfaces. The network type light sets are not only varied in arrangements and shapes, they are also easy to install or store.

Although the present invention has been illustrated and described with reference to the preferred embodiments thereof, it should be understood that it is in no way limited to the details of such embodiments but is capable of numerous modifications within the scope of the appended claims.

What is claimed is:

1. A decorative network type light set comprising:

an AC plug, an AC wire, and a plurality of DC lead wires branching from an adapter, said lead wires are interwoven to form a light emitting surface, said light emitting surface includes a plurality of light bulbs equidistantly disposed thereon; wherein a plurality of fastening elements are affixed at junctions of said lead wires to hold said lead wires in place, said fastening elements include a light bulb holder with a light bulb mounted therein, and a plurality of securing elements secure at least one of said lead wires to a rope surrounding a periphery of said light emitting surface, thereby facilitating deployment of said network type light set.

2. The decorative network type light set as claimed in claim 1 wherein:

said securing elements are made of elastic plastic material, said securing elements comprise a band-like securing strip with a first end thereof forming a securing seat, and a second end thereof forming a hook, said hook may be bent and inserted into said seat to form an annular securing means.

* * * * *